United States Patent [19]

Siraty

[11] Patent Number: 4,743,080

[45] Date of Patent: May 10, 1988

[54] FLAT CABLE CONNECTOR

[75] Inventor: Masseud Siraty, Santa Monica, Calif.

[73] Assignee: G & H Technology, Inc., Camarillo, Calif.

[21] Appl. No.: 911,979

[22] Filed: Sep. 25, 1986

[51] Int. Cl.[4] ..... H01R 13/52

[52] U.S. Cl. ..... 439/492; 439/271; 439/607; 439/723

[58] Field of Search ..... 339/17 LM, 17 M, 94 R, 339/94 M, 143 R, 176 MP, 205

[56] References Cited

U.S. PATENT DOCUMENTS

| | | | |
|---|---|---|---|
| 3,307,139 | 2/1967 | Prise | 339/205 |
| 4,358,173 | 11/1982 | Conrad | 339/17 M |
| 4,421,370 | 12/1983 | Treakle et al. | 339/17 M |

*Primary Examiner*—Joseph H. McGlynn

[57] ABSTRACT

The invention is directed to a connector for two flat electrical cables having the same plurality of conduits. The electricity passes from one conduit to the corresponding conduit by way of a dielectric insert having a parallel array of conductive spring-like finger contacts to complete the circuits; such as, double ended cantilevered single leaf springs. For EMI/EMP shielding an elastomeric conductive material seal surrounds horizontally the connection within the connector.

12 Claims, 5 Drawing Sheets

FLAT CABLE CONNECTOR

BACKGROUND OF THE INVENTION

1. Field of the Invention

The instant invention relates to a connector capable of readily connecting, demounting and reconnecting two electrical plural-conduit flat cables.

2. Description of the Prior Art

Illustrative of electrical cable connectors of interest for connecting two cables each having a plurality of electrical conduits are Reardon II U.S. Pat. No. 4,125,310, issued Nov. 14, 1978 on an application filed Dec. 1, 1975 and Moulin U.S. Pat. No. 4,453,795, issued June 12, 1984 on an application asserting an earlier filing date of Dec. 1, 1975.

OBJECTS OF THE INVENTION

One object of the invention is an electrical connector which permits easy connecting, demounting and reconnecting of two flat cables when inspection, replacement or addition of new parts is called for.

Other objects of the invention include:

An electrical connector for two multi (polyplural) conduit flat cables providing certainty of electrical connection for each corresponding pair of conduits.

A connector of simple compact design: for low cost and reliability.

A connector having a large electrical contact area: for greater current-carrying capacity.

A connector that is not sensitive to vibration.

A connector having a feature to assure constant and independent contact engagement pressure.

A connector where demounting and reconnecting, over many repeats, may be done without damage or reduced performance of either the connector or the cable ends.

A connector which provides firm, even pressure for all the cable connections.

A connector which provides a full-mate (complete connection) indication, i.e., reveals even partial separation of the electrical connection.

A connector which is protected (sealed) against invasion by environmental forces.

A connector which is shielded with respect to EMI-/EMP forces.

Other objects of the invention will become evident in the detailed description.

SUMMARY OF THE INVENTION

The invention is directed to a connector connecting corresponding conduits of two plural-conduit flat electrical cables which connector comprises a plurality of elongated electrical conductive means, each having compressive spring-like elements ending at, or substantially at, each end of said conductive means; a dielectric insert means adapted to maintain said elongated conductive means in a rectilinear array, electrically insulated one from another, with said spring-like elements on two parallel transverse planes; a first container means for receiving said insert means, said first container means being electrically insulated from said insert means; a second container means adapted to close with said first container means, said second container means being electrically insulated from said insert means, to electrically connect the corresponding exposed conduit ends of two flat electrical cables when these cables have been inserted into the then-open opposite sides of said container, formed by said two container means, to contact said corresponding elongated electrical conductive means; and said container having at least one elastomeric member for sealing the interior of said closed container. Preferably said elongated electrical conductive means are made of copper coated with gold. Preferably at least one elastomeric member is electrically conductive to provide a shield against EMI/EMP forces.

In one embodiment the compressive spring-like elements have a substantially flat transverse surface, to receive a flat electrical conduit. Desirably these spring-like elements have a substantial flat top. In another embodiment the compressive spring-like elements have a transverse surface adapted to receive a substantially circular electrical conduit.

A preferred embodiment of the connector invention comprises: a plurality of elongated electrical conductive means, each having compressive spring-like finger-elements, having a substantially flat transverse surface and ending substantially at each end of said conductive means; a dielectric insert means adapted to maintain said elongated conductive means in a rectilinear array, electrically insulated one from another, with spring-like elements on two parallel transverse planes; a housing means comprising a base member and a cover member, said housing means being electrically insulated from said insert means, which insert means is positioned within said housing means; at least one elastomeric member positioned within said housing means, spaced apart from said insert means, to seal the interior of said housing means after the electrical connection has been completed: said cover member being adapted to bring said finger-elements into electrical connection with the corresponding exposed flat conduit ends of two flat electrical cables when these have been inserted into the then-open-opposite sides of said housing means to contact said corresponding elongated electrical conductive means, and said cover member and said base member are sealingly joined to form a connector housing.

Desirably the elongated compressive spring-like elements have a substantial flat top. Preferably the elongated compressive spring-like elements are made of copper coated with gold.

The elastomeric member provides against invasion by environmental forces; for such purposes these are typically made of neoprene rubber or of silicone rubber. Also an elastomeric member can function to shield the connector assembly from EMI/EMP forces; for such purpose these are made of conductive materials, such as conductive silicone rubber. A combination of dielectric elastomer and conductive elastomer can be used to give fully sealing and shielding benefits.

Desirably the cover member includes two dielectric elastomeric members each aligned over one of the two lines of contact of said finger-elements and the conduits of the two cables to be connected to bring these into electrical connection when said cover member is brought into sealing joinder with said base member.

DETAILED DESCRIPTION

FIGS. 1–3

Figure 1:
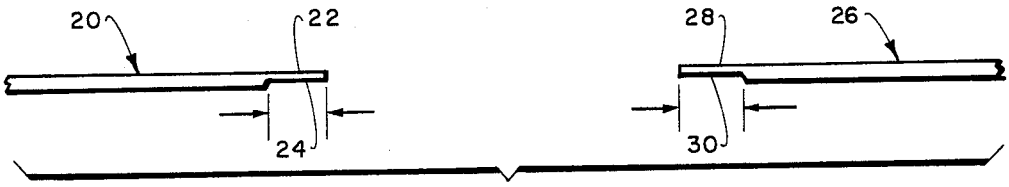
FIG. 1 depicts in a side view two horizontally spaced apart flat electrical cables: two conduits have ends stripped of insulation on the bottom side.
Figure 2:
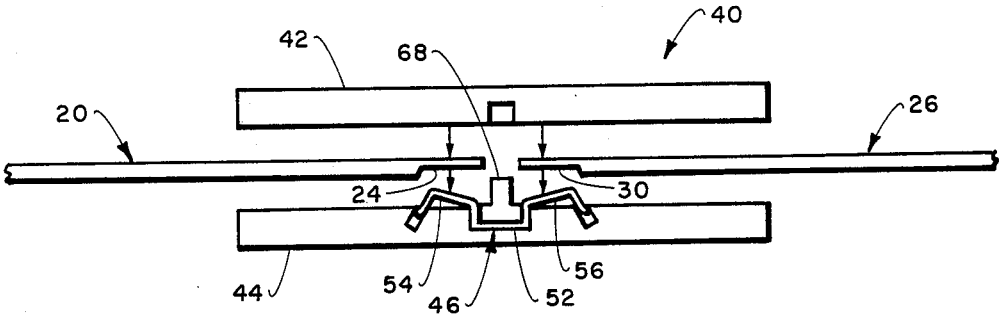
FIG. 2 depicts the stripped cables inserted into a connector: dielectric cover and base with double cantilevered connection finger contacts.
Figure 3:
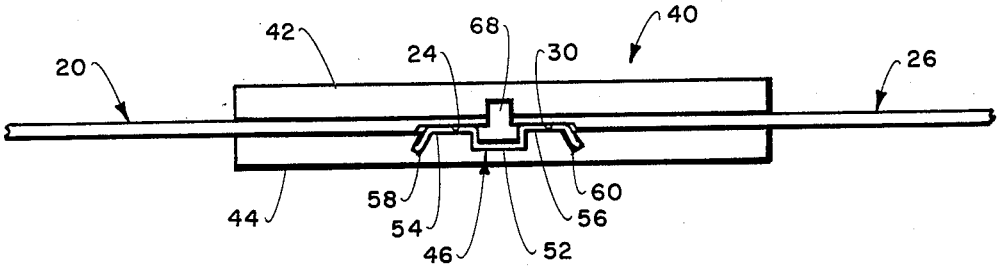
FIG. 3 depicts the connection completed: the cover compresses the exposed conduit end onto the finger-contacts, squashing these flat.

FIGS. 1–3 show, somewhat crudely but clearly, the essence of the invention. FIG. 1 shows two flat electrical cables 20 and 26, the ends 22 and 28 of two corresponding conduits have been stripped of insulation on the bottom sides 24 and 30; ends 22 and 28 and a portion of the insulated cables are inserted (FIG. 2) into a connector assembly 40 made up of a first container means (a cover member) 42 located above the conduit conductor ends 24 and 30 to be connected. Below the two cables and exposed conduit ends is a second container means 44 (a base member) which is provided with an elongated recess 46.

Positioned in recess 46 is a rectilinear array, in transverse arrangement of elongated electrical conductive means 52 (only one is shown), each means 52 having compressive spring-like elements 54 and 56 on two parallel planes transverse to the line of recess 46. The defined electrical conductive means 52 are electrically insulated one from another. FIG. 3 shows the spring-like elements 54 and 56 each physically end before the terminus of the means 52, nevertheless substantially at the two terminus-ends 58 and 60 of means 52. The array of elongated conductive means 52 is maintained securely in recess 46 by a dielectric insert member 68, which also bars contact between the terminus-ends of the two conduits of cables 20 and 26 (FIG. 3).

First container means 42 is closed over second container means 44 (FIG. 3) with sufficient force to compress the stripped conduit ends firmly against the flat transverse surface of spring-like elements 54 and 56 against portions (not numbered) of container means 44 and driving terminus-ends 58 and 60 into recesses (not numbered) provided in container means 44. Thus a relatively large electrical contact area is provided between conduit stripped ends 24 and 30 and spring-like elements 54 and 56, respectively.

Elongated electrical conductive means 52 may be made of any suitable conductive material. Copper metal (which herein includes copper alloys) is preferred. Normally, the copper is coated with a noble metal, preferably gold.

Although not shown in FIGS. 2–3, it is to be understood that container 40 includes at least one elastomeric member for sealing the interior of the closed container, after the connection has been completed. Also shielding against EMI/EMP forces may be provided within the closed container.

FIGS. 4–8

FIGS. 4–8 show an embodiment of the invention suitable for flat cables whose conduits have substantially circular conductor cores; in this instance the conductors are substantially circular flexible, stranded copper wire cores.

Figure 4:
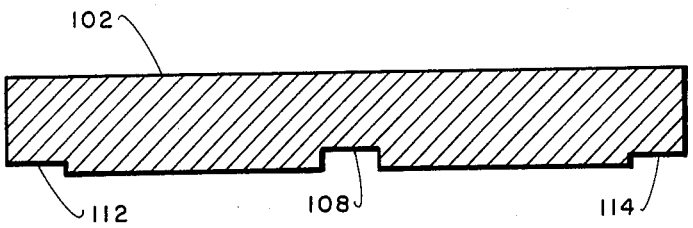
FIG. 4 depicts in cross-section a dielectric cover plate, for another embodiment of the invention.
Figure 7:
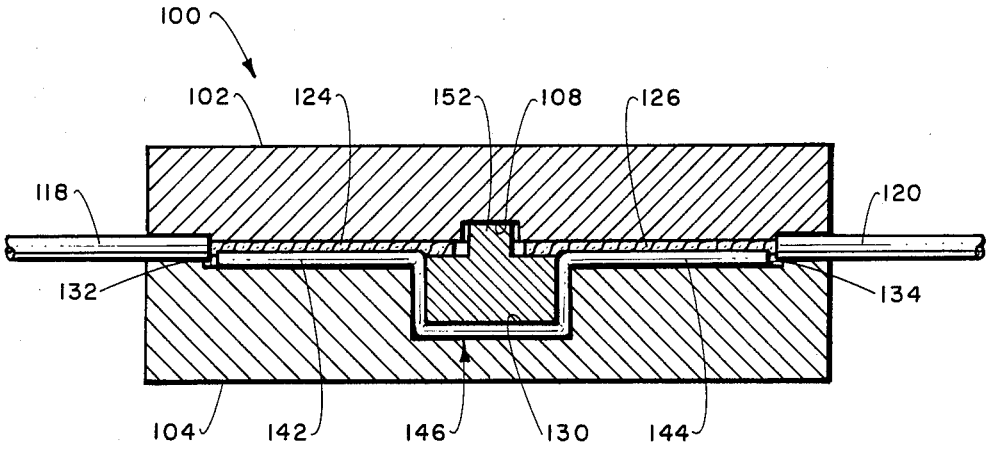
FIG. 7 depicts, in side cross-section, a connector completed connection, the conduit ends being brought into electrical contact with the leaf-spring conductors (by compressing the leaf flat).

FIG. 7 shows the completed connection within a housing means 100 comprising a cover member 102 and a base member 104. FIG. 4 shows cover member 102 is provided with a longitudinal cut 108 and end cuts 112 and 114.

Figure 5:
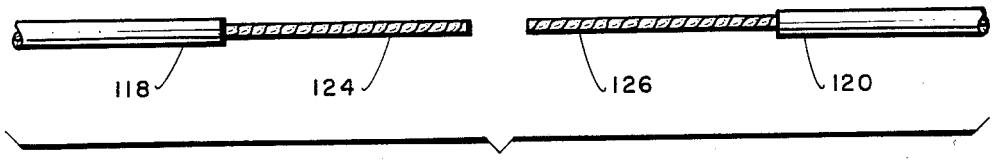
FIG. 5 depicts in a side view two spaced apart flat cables made up of a plurality of flexible substantially circular conduits, with ends stripped to bare wire core.

FIG. 5 shows in end view two plural-conduit cables 118 and 120 with fully stripped substantially circular flexible strand cores 124 and 126.

Figure 6:
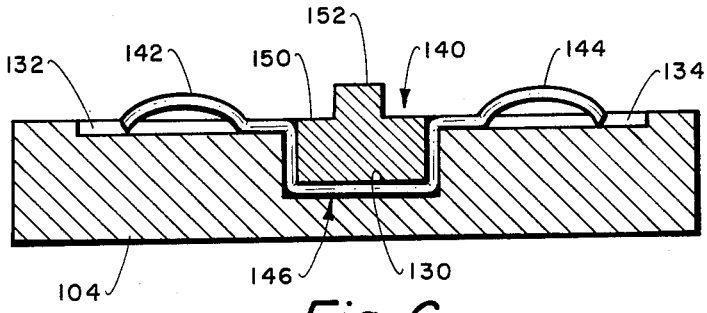
FIG. 6 depicts, in a side cross-section, a dielectric base plate, one double cantilevered single leaf-spring conductor, held in place by a dielectric member.

FIG. 6 shows base member 104 having a longitudinal recess 130 and shallow longitudinal depressions 132 and 134 extending from recess 130 toward the edges of base member 104 far enough to receive spring-like elements 142 and 144 when these are flattened during connection. One of a plurality of elongated electrical conductive means 140, each having compressive single leaf-spring-like elements 142 and 144 (also known as finger-elements) ending at each end of said conductive means, is shown. Central portion 146 of means 140 fits into recess 130. Dielectric insert 150 is positioned within recess 130 maintaining securely and electrically separate the rectilinear array of conductive means 140 located within recess 130. Insert means 150 has a top projection 152 which fits into cut 108 of cover member 102.

FIG. 7 shows the connector in a completed connection condition. The exposed conduit cores 122 and 124 ends of the two cables 118 and 120 have been inserted into the then-open-opposite sides of housing means 100 to contact the corresponding electrical conductive means finger-elements 142 and 144 and the cover member 102 and base member 104 were sealingly joined to form the connector housing and assembly. Sufficient compressive force is exerted to push the finger-elements 142 and 144, substantially flat in depressions 132 and 134, providing a relatively large area of electrical contact between the exposed cores 124 and 126 and finger-elements 142 and 144, respectively.

Not shown is elastomeric member(s) which seals the interior of the connector assembly when the cover member and base member are brought into sealing joinder.

Figure 8:
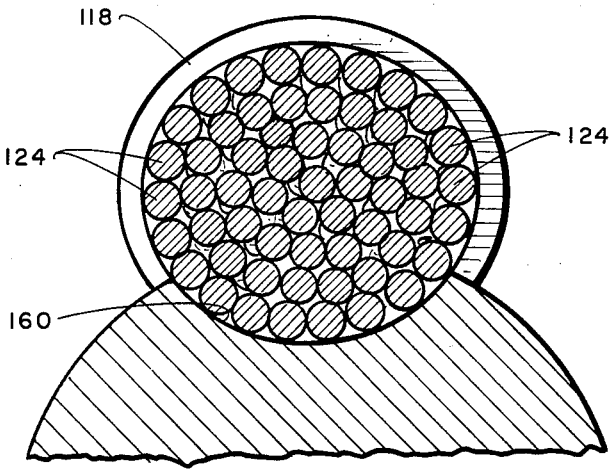
FIG. 8 shows the transverse surface of one leaf-spring contact conforms to a substantial arc of the circular circumference of the stripped flexible stranded conductor core of the conduit with the protective sheath beyond.

FIG. 8 is a detail showing the arcuate transverse surface 160 of one finger-element adapted to receive a substantially circular stranded wire core 124; the sheath of conduit 118 appears beyond the exposed core.

FIGS. 9–10

Figure 9:
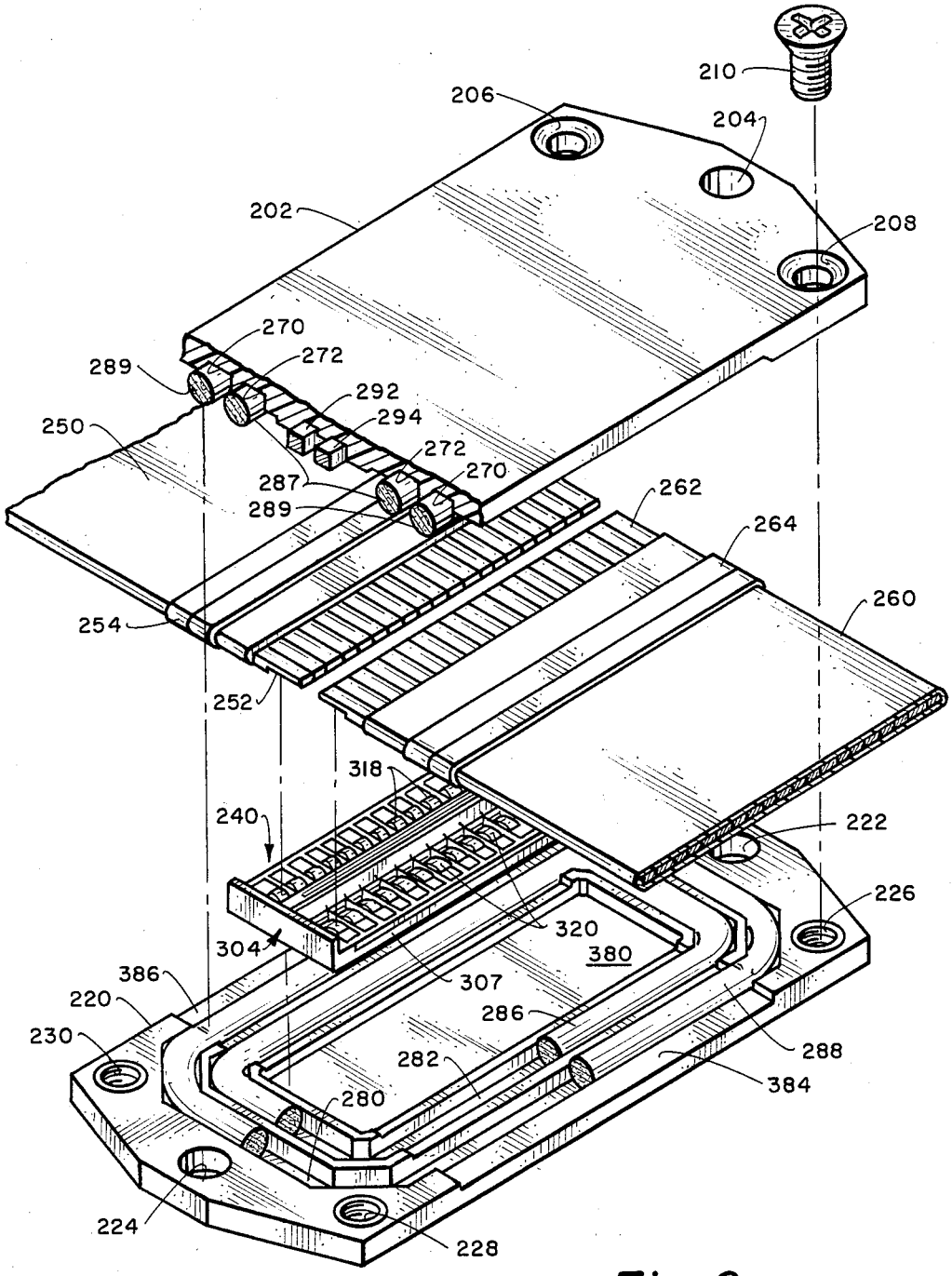
FIG. 9 is an exploded view of another embodiment of the connector of the invention, directed toward flat conductor conduits in a plural-conduit flat cable.
Figure 10:
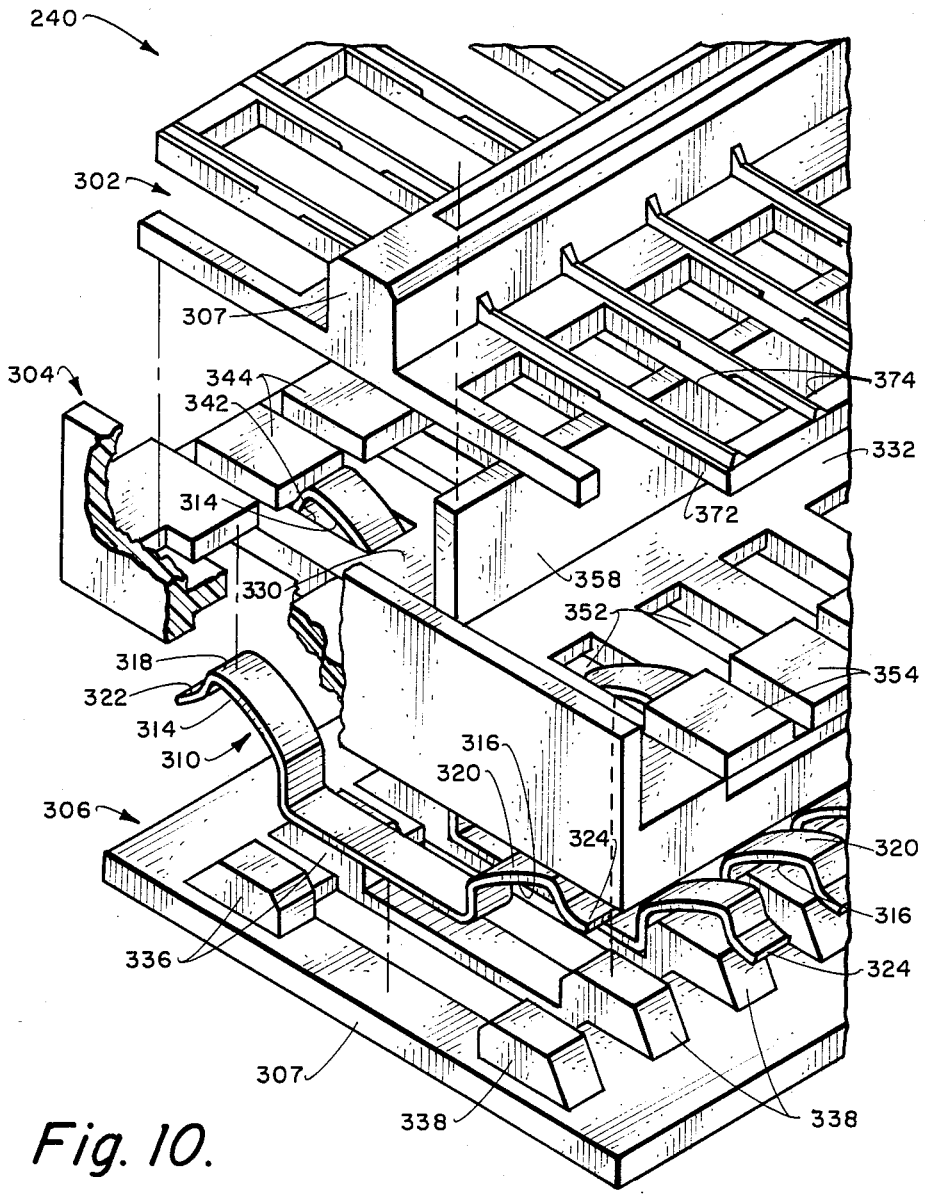
FIG. 10 is an enlarged detailed exploded view of the insert and elongated conductive means with compressive spring-like elements (finger-elements) as utilized in FIG. 9.

FIGS. 9–10 present a more sophisticated embodiment of the connector of the invention, shown in exploded view of the entire connector and two flat cables with flat conduits ready for connection; and an exploded view of the insert means with an array of finger-elements having a flat transverse surface and a substantial flat top.

In FIG. 9 cover member 202, in partial view, is provided with alignment hole 204 and closure screw holes 206 and 208 (two others not shown). One screw 210 is shown. Base member 220 is provided with alignment holes 222 and 224, and closure screw holes 226, 228 and 230 (one screw hole corresponding to screw hole 206 is not shown).

Dielectric insert means 240 is adapted to maintain the elongated conductive means in a rectilinear array, electrically insulated one from another, with finger-elements on two parallel transverse planes will be described in detail as shown in FIG. 10.

The two flat plural-conduit cables 250 and 260, having 20 conduits each with each conduit having a flat conductor core, are shown inserted into the connector housing means comprising cover member 202 and base member 220 with conduit ends 252 and 262 each stripped of insulation on the lower side of the conduit. Each cable is provided with a colored warning band, 254 and 264, respectively, to serve as a full-mate indicator; this band reveals even partial separation of the connection.

In this embodiment cover member 202 and base member are made from an aluminum alloy, such as, aluminum alloy 6061. Shield flat-flex Raychem F/NEPD is an example of the multicable suitable for use with this connector.

Cover member 202 and base member 220 each have two corresponding circumferential grooves, on their mating faces, spaced apart from insert means 240, grooves 270 and 272 in the cover member and grooves 280 and 282 in the base member. Each groove in base member 220 is provided with elastomeric gaskets 286 and 288. Gaskets of elastomeric material 287 and 289 are positioned in cover member grooves 270 and 272, respectively.

Two or all four of the elastomeric gaskets may be used to seal the interior of the housing-connector when the connection is completed. by the pressure of the four closure screws. Or these gaskets may be used for both sealing and for providing an EMI/EMP shield, by the use of an electrically conductive elastomeric material. Illustrative of a dielectric elastomer is Santoprene 101-80 thermoplastic rubber (neoprene rubber) of Monsanto Co. Illustrative of a conductive elastomer is SE65-ConSilicone rubber of Stockwell Rubber Co, Philadelphia, Pa.

In this embodiment, grooves 272 and 282 each contain a dielectric elastomeric gasket 286 and 287 to provide an environmental seal and grooves 270 and 280 contain electrically conductive gaskets 288 and 289 to provide an EMI/EMP shield.

On the underside of cover members 202 (FIG. 9) are two longitudinal dielectric elastomeric strips 292 and 294 each positioned over one of the two transverse planes made by conduit ends 252 and 262, respectively. These dielectric strips also act as pressure pads to transfer force from the cover member to the cable conduit/-finger-element interface when the cover/base is tightened, to provide firm, even pressure on all the electrical connections. A relatively soft elastomer is preferred for strips 292 and 294.

FIG. 10 shows insert means 240 is made up of a rubber insulator interface seal 302 and two dielectric plastic material members 304 and 306, herein, a "Delrin" acetal resin, which in sum are adapted to maintain a plurality of elongated electrical conductive means 310 in rectilinear array, electrically insulated one from another, compressive finger-elements 314 and 316, said finger-elements 314 and 316 having a substantially flat transverse surface 318 and 320 and ending substantially at the end 322 and 324 of said conductive means 310; said finger-elements are aligned on two parallel transverse planes, i.e., transverse to said rectilinear array alignment; said transverse plane being approximately delimited by the longitudinal area 330 and 332 of member 304.

Three elongated means 310 are shown at the near end 307 of bottom insert means 306 giving an appreciation of the rectilinear array of these means 310; for a 20 conduit cable, that is, cables 250 and 260, has an array of 20 elongated means 310. (Also note means 240 in FIG. 9). Bottom member 306 is provided with anvils 336 and 338 for each elongated conductive means 310. Finger-elements 314 and 324, respectively, are positioned in contact distance above said anvils 336 and 338.

Middle insert member 304 is provided with spaced apart slot-openings 342 and 352 through which finger elements 314 protrude and stops 344 and 354 which catch ends 322, in order to maintain said elongated members 310 in alignment. Middle insert member 304 is provided with a longitudinal spine, mid-transverse location, 358 which aligns upper insert member 302 when this is lowered onto member 304.

Upper insert member 302 has a longitudinal inverted channel element 370 whichs over spine 358 and a plurality of transverse elements 372 which electrically insulate adjacent finger-elements one from another, in separate compartments 374, and keep the opposing conduit ends 252 and 262 from meeting each other.

The insert members are bonded together to form a permanent retainer for the array of elongated members.

The completed dielectric insert means 240 is positioned into a rectangular recess 380 in the upper side of base member 220 (FIG. 9), the cover member 202 is set using the alignment holes 204 and 224 and loosely joined by the four screws, 210 et al, leaving open-opposite sides 384 and 386 of the connector housing for insertion of the two cable conduit ends, which are automatically positioned over the corresponding finger-elements. As the screws 210, et al, are tightened, pressure pads 292 and 294 compress the finger-elements down onto the anvils and force the stripped conduit cores into good electrical contact with the finger-elements. Electric current flows from one conduit by way of the elongated conductive means to the other cable conduits and the connection is completed. Simultaneously the cover member and base member are sealingly joined for both environmental and EMI/EMP protection.

In this embodiment the elongated conductive means are made of beryllium copper alloy, heat treated and then gold plated.

RESULTS

Tests were conducted to determine how contact force affects electrical resistance for a flat spring finger contact. The contacts used were unplated beryllium copper alloy. The results show that a contact force of 2 oz. would produce an electrical resistance of 2.5 milliohms (or less) at one amp DC. For a 20 conductor connection, this translates into a minimum force of 40 oz. to obtain 2.5 milliohms resistance. With a design margin of 100%, 4 oz. per connection, this force is well within the structural capacity of the conductor housing and inserts.

Thus having described the invention, what is claimed is:

1. A connector for electrically connecting corresponding conduits of two plural-conduit flat electrical cables which connector comprises:

(1) a plurality of elongated electrical conductive means, each having compressive spring-like elements ending at, or substantially at, each end of said conductive means;

(2) a dielectric insert means adapted to maintain said elongated conductive means in a rectilinear array, electrically insulated one from another, with said spring-like elements on two parallel transverse planes;

(3) a first container means for receiving said insert means, said first container means being electrically insulated from said insert means;

(4) a second container means adapted to close with said first container means, said second container means being electrically insulated from said insert means, to electrically connect the corresponding exposed conduit ends of two flat electrical cables when these cables have been inserted into the then-open opposite sides of said container, formed by said two container means, to contact said corresponding elongated electrical conductive means; and (5) said container having at least one elastomeric member for sealing the interior of said closed container.

2. The connector of claim 1 wherein at least one elastomeric member of (5) is electrically conductive to provide a shield against EMI/EMP forces.

3. The connector of claim 1 wherein said compressive spring-like elements of (1) have a transverse surface adapted to receive a substantially circular electrical conduit.

4. The connector of claim 1 wherein said elongated electrical conductive means of (1) are made of copper coated with gold.

5. The connector of claim 1 wherein said compressive spring-like elements of (1) have a substantially flat transverse surface, to receive a flat electrical conduit.

6. The connector of claim 5 wherein said compressive spring-like elements have a substantial flat top.

7. A connector for electrically connecting corresponding flat conduits of two plural-conduit flat electrical cables, which connector comprises:

(a) a plurality of elongated electrical conductive means, each having compressive spring-like finger-elements, having a substantially flat transverse surface and ending substantially at each end of said conductive means;

(b) a dielectric insert means adapted to maintain said elongated conductive means in a rectilinear array, electrically insulated one from another, with spring-like elements on two parallel transverse planes;

(c) a housing means comprising a base member and a cover member, said housing means being electrically insulated from said insert means, which insert means is positioned within said housing means;

(d) at least one elastomeric member positioned within said housing means, spaced apart from said insert means, to seal the interior of said housing means after the electrical connection has been completed;

(e) said cover member being adapted to bring said finger-elements into electrical connection with the corresponding exposed flat conduit ends of two flat electrical cables when these have been inserted into the then-open-opposite sides of said housing means to contact said corresponding elongated electrical conductive means, and said cover member and said base member are sealingly joined to form a connector housing.

8. The connector of claim 7 wherein there is present within said housing means an electrically conductive elastomeric member, spaced apart from said insert means, to provide an EMI/EMP shield when said connector housing is sealed.

9. The connector of claim 7 wherein said housing means includes both a dielectric elastomeric member and an electrity conductive EMI/EMP elastomeric member to seal and to shield said connector after the connection has been completed.

10. The connector of claim 7 wherein said cover member includes two dielectric elastomeric members each aligned over one of the two lines of contact of said finger-elements and the conduits of the two cables to be connected, to bring these into electrical connection when said cover member is brought into sealing joinder with said base member.

11. The connector of claim 7 wherein said elongated compressive spring-like finger-elements of (a) have a substantial flat top.

12. The connector of claim 11 wherein said finger-elements are made of copper coated with gold.

* * * * *